US011724926B2

(12) United States Patent
Rider et al.

(10) Patent No.: US 11,724,926 B2
(45) Date of Patent: Aug. 15, 2023

(54) BEVERAGE CONTAINER IDENTIFICATION AND DISPENSING CONTROL

(71) Applicant: Coravin, Inc., Burlington, MA (US)

(72) Inventors: Michael Rider, Lowell, MA (US); Francois Claude Raoul Silvain, Winchester, MA (US); Gregory Lambrecht, Natick, MA (US)

(73) Assignee: Coravin, Inc., Bedford, MA (US)

( * ) Notice: Subject to any disclaimer, the term of this patent is extended or adjusted under 35 U.S.C. 154(b) by 72 days.

(21) Appl. No.: 15/974,908

(22) Filed: May 9, 2018

(65) Prior Publication Data

US 2018/0327243 A1 Nov. 15, 2018

Related U.S. Application Data

(60) Provisional application No. 62/504,037, filed on May 10, 2017.

(51) Int. Cl.
*B67D 1/00* (2006.01)
*B67D 1/08* (2006.01)
(Continued)

(52) U.S. Cl.
CPC ..... *B67D 1/0004* (2013.01); *B67D 1/0412* (2013.01); *B67D 1/0418* (2013.01);
(Continued)

(58) Field of Classification Search
CPC .. B67D 1/0004; B67D 1/0885; B67D 3/0048; B67D 3/0077; B67D 1/0418;
(Continued)

(56) References Cited

U.S. PATENT DOCUMENTS 9,550,662 B1 * 1/2017 Brown ..... G07F 13/025
2005/0087255 A1 4/2005 Humphrey et al.
(Continued)

FOREIGN PATENT DOCUMENTS

EP 0 726 225 A1 8/1996
WO 01/43096 A2 6/2001

OTHER PUBLICATIONS

Rhik Samadder, Kitchen gadgets review: Coravin wine access system—aimed at a classier market than me, Jan. 13, 2016, The Guardian, https://www.theguardian.com/lifeandstyle/2016/jan/13/coravin-wine-access-system-gadget-review-rhik-samadder. (Year: 2016).*

(Continued)

*Primary Examiner* — Allen C Chein
*Assistant Examiner* — Aaron N Tutor
(74) *Attorney, Agent, or Firm* — Wolf, Greenfield & Sacks, P.C.

(57) ABSTRACT

A system and method for dispensing beverage from a container, such as wine from a wine bottle. An identification element may be secured to a beverage container and include a tag and optically readable code that uniquely identify the container. A dispenser may dispense beverage from a container, and be able to read the tag of the identification element. Information regarding characteristics of beverage in the beverage container may be associated with a corresponding identification element and include a brand, type, vintage or volume of beverage in the container.

21 Claims, 8 Drawing Sheets

(51) Int. Cl.
*B67D 3/00* (2006.01)
*B67D 1/04* (2006.01)

(52) U.S. Cl.
CPC ..... *B67D 1/0877* (2013.01); *B67D 1/0884* (2013.01); *B67D 1/0885* (2013.01); *B67D 3/0006* (2013.01); *B67D 3/0048* (2013.01); *B67D 3/0077* (2013.01); *B67D 2001/0098* (2013.01)

(58) Field of Classification Search
CPC .. B67D 1/0412; B67D 3/0006; B67D 1/0884; B67D 1/0877; B67D 2001/0098; B67D 1/1252; B67D 2001/0093; B67D 1/0888; B67D 2210/00091; B67D 1/0007; B67D 1/0005; B67D 1/14; B67D 2001/0481; B67D 2210/00089
See application file for complete search history.

(56) References Cited

U.S. PATENT DOCUMENTS

2009/0237221 A1* 9/2009 Battles ..... G06K 19/08 340/10.51
2013/0105583 A1* 5/2013 Peterson ..... A01M 7/0089 235/492
2015/0284163 A1* 10/2015 Manwani ..... B67D 3/007 222/105
2017/0001850 A1* 1/2017 Rider ..... B65D 23/0871
2018/0072553 A1* 3/2018 Lyons ..... A47J 31/40
2018/0280896 A1* 10/2018 Perkins ..... B01F 23/23765

OTHER PUBLICATIONS

Invitation to Pay Additional Fees for International Application No. PCT/US2018/031836, dated Aug. 7, 2018.
International Search Report and Written Opinion for International Application No. PCT/US2018/031836, dated Oct. 8, 2018.

* cited by examiner

BEVERAGE CONTAINER IDENTIFICATION AND DISPENSING CONTROL

RELATED APPLICATIONS

This Application claims priority under 35 U.S.C. § 119(e) to U.S. Provisional Application Ser. No. 62/504,037, entitled "BEVERAGE CONTAINER IDENTIFICATION AND DISPENSING CONTROL" filed on May 10, 2017, which is herein incorporated by reference in its entirety.

BACKGROUND OF INVENTION

This invention relates generally to the dispensing or other extraction of fluids from within a container, e.g., in the dispensing of wine from a wine bottle.

SUMMARY OF INVENTION

One or more embodiments in accordance with aspects of the invention allow a user to extract or otherwise dispense a beverage, such as wine, from within a bottle that is sealed by a cork, plug, elastomeric septum or other closure without removing the closure. In some cases, removal of liquid from such a bottle may be performed one or more times, yet the closure may remain in place during and after each beverage extraction to maintain a seal for the bottle. Thus, the beverage may be dispensed from the bottle multiple times and stored for extended periods between each extraction with little or no effect on beverage quality. In some embodiments, little or no gas, such as air, which is reactive with the beverage may be introduced into the bottle either during or after extraction of beverage from within the bottle. Thus, in some embodiments, a user may withdraw wine from a wine bottle without removal of, or damage to, the cork, and without allowing air or other potentially damaging gasses or liquids entry into the bottle.

In some embodiments, a beverage extractor or dispensing device may be secured to the neck of the bottle, such as by clamping a portion of the extractor to the bottle neck, and a needle or other conduit of the beverage extractor may be inserted through the closure (such as a cork of a wine bottle) so that a distal end of the needle is positioned inside of the bottle. Thereafter, pressurized gas may be injected into the bottle via the needle while the bottle is positioned in the bottle support sleeve. The injected gas may be pressure regulated, e.g., to a pressure of 20-50 psi, or not regulated. For example, pressure in the bottle may allow beverage to flow through the needle and out of the bottle. In some embodiments, the extractor needle may include two lumens or two needles, one for gas and another for beverage, e.g., so that gas may be injected simultaneously with beverage flow out of the bottle.

In one embodiment, a container-mounted beverage dispensing system includes a beverage dispenser arranged to dispense beverage from a beverage container, and an identification element arranged to be secured to the beverage container. The identification element can include a tag arranged to provide non-optical information to a non-optical reader of the beverage dispenser and that uniquely identifies the tag from other tags. Thus, the beverage dispenser can uniquely identify a beverage container to which the identification element is attached by using the non-optical reader to receive indicia from the tag. As an example, the tag can be an RFID tag that sends a radio frequency signal to an RFID reader of the beverage dispenser. In some cases, reading of the tag by the dispenser can indicate that the dispenser is mounted on a container, e.g., the dispenser may only be able to read a tag that is positioned sufficiently close and/or in a particular area relative to the dispenser that indicates the dispenser is mounted to a container.

The identification element can also include an optically-readable code that is machine readable by a device that optically images the code. For example, the optically-readable code can include a traditional barcode, 2-dimensional barcode, QR code, alphanumeric text or other optically-readable information. The optically-readable code of the identification element may in some cases allow information regarding the beverage in a beverage container to which the identification element is secured to be associated with the identification element. For example, a user may be able to relatively easily associate beverage-specific information with the identification element using the optically readable code. In one embodiment, after securing an identification element to a container, a user may image the optically-readable code of the identification element and a label on the beverage container. In some cases, the optically-readable code and the label may be imaged in a same set of image data, e.g., in a same picture. The optically-readable code may be identified by image analysis, e.g., an alphanumeric string or other identifier associated with the optically-readable code may be decoded or otherwise determined, and the label on the beverage container may be subjected to image analysis as well, e.g., to determine a brand and type of beverage by optical character recognition of text on the label. Alternately, the label need not be subjected to image analysis, and the user may input a beverage brand, type, volume and/or other information via a user interface, e.g., by voice or manually input text. This information may be stored in a computer system, e.g., the optically-readable code identifier and the beverage information for each identification element and beverage container pair may be stored in records of a database or other storage arrangement of the computer system. Thus, the identification element, both the tag indicia and the optically-readable code identifier, may be associated with beverage-specific information for a container to which the identification element is secured and stored for later use. Such information may be used in a variety of different ways, such as allowing a user to manage multiple containers in the user's collection by providing a beverage inventory list to the user, indicating how much beverage remains in particular beverage containers, indicating a first date, or dates, on which beverage was dispensed from a container, etc. In some embodiments, a user may query the computer system to identify containers meeting particular criteria, such as wine of a particular type or vintage in the collection, and the computer system may provide a display of results. In other cases, the computer system may display information to a user regarding a beverage currently being dispensed by a beverage dispenser, e.g., a display of the container label may be made, along with other information such as food pairings, similar tasting wines or other beverages, other beverages in the collection that were previously dispensed with this beverage, etc.

Also, the beverage dispenser may use beverage-specific information for a particular container to control one or more features of the beverage dispenser. For example, the beverage dispenser may receive indicia from a tag on a beverage container, and may receive or retrieve beverage-specific information associated with the container to which the identification element is secured. For example, the beverage dispenser may receive information regarding an amount of beverage remaining in the container, and control the flow of pressurized gas into the container in a suitable way to achieve a desired dispense rate (containers with less beverage remaining may require a higher gas flow rate to achieve a same beverage dispense rate as containers that are more full). The beverage dispenser can also provide information regarding dispensing of the beverage, e.g., an amount dispensed and/or a date of dispensing from the container, which may be associated with the identification element, and thus the beverage container. This information may be used to update the record information, e.g., the computer system may update a record corresponding to the container and identification element to reflect the changed amount of beverage remaining.

In one embodiment, a beverage dispenser may include at least one conduit to deliver gas into a container holding a beverage and to receive beverage from the container for dispensing in a user's cup. For example, a single or multiple lumen needle or other conduit may be provided and arranged to be inserted through a cork or other closure of a wine bottle. At least one valve may be used to control gas flow into the container or beverage flow out of the container via the at least one conduit. For example, a gas control valve may be arranged to control flow of gas from a source of pressurized gas to the at least one conduit, and a beverage control valve may be arranged to control flow of beverage from the at least one conduit to a beverage outlet. A non-optical reader may read information from a tag of an identification element on a beverage container, and control circuitry of the dispenser may be arranged to send or receive information regarding the indicia, such as to receive information regarding a volume of beverage remaining in the container or to send information regarding a volume of beverage dispensed. This information may be useful where the dispenser is used to dispense beverage, is disengaged from the container, and then reengaged at a later time to dispense beverage. Based on indicia received from a tag of an identification element on a container, the control circuitry may recall the amount of beverage remaining in the container and control dispensing accordingly, e.g., by controlling gas flow into the container based on an amount of beverage remaining. In some cases, the control circuitry may be arranged to determine an amount of beverage remaining in the container during dispensing based on an amount of gas delivered to the container. For example, the control circuitry may determine an amount of gas delivered to the container based on a time that a gas control valve is open to deliver pressurized gas to the container. Where the gas is pressure regulated or other characteristics of gas flow rate can be known, the control circuitry may determine an amount of gas delivered based on the flow rate and open time for the gas valve.

In another embodiment, a beverage management system includes a plurality of identification elements each arranged to be secured to a beverage container. Each identification element may include a tag arranged to provide information to a non-optical reader including indicia that uniquely identifies the tag from other tags, and an optically-readable code that is machine readable by a device that optically images the code and that represents an identifier that uniquely identifies the optically-readable code from other codes. A computer device may include a memory to store a plurality of records each corresponding to an identification element, with each of the plurality of records including information regarding a beverage in a beverage container to which a corresponding identification element is secured.

In some embodiments, the records may include information regarding a volume of beverage in each beverage container, a brand of the beverage in the beverage container, a type of the beverage in the beverage container, a vintage of the beverage in the container, or at least one date on which beverage was dispensed from the beverage container. In some embodiments, a beverage dispenser may be arranged to receive the indicia from the tag on a container and to dispense beverage from the container. The beverage dispenser may be arranged to send information to the computer device regarding a date on which beverage is dispensed from the container or a volume of beverage dispensed from the container, and the computer device may be arranged update a record corresponding to the container to include the information from the beverage dispenser. In some cases, a user computer device may be arranged to receive information from a computer server regarding one or more records and to display the information on the user computer device to a user. The displayed information may include at least one of a volume of beverage in a beverage container, a brand of the beverage in the beverage container, a type of the beverage in the beverage container, a vintage of the beverage in the container or at least one date on which beverage was dispensed from the beverage container. Use of the term "record" is not intended to require any particular database format or even use of a database structure at all to store and manage information regarding identification elements and associated beverage information. Instead, "record" information may be stored in any suitable way.

Various exemplary embodiments of the device are further depicted and described below.

BRIEF DESCRIPTION OF THE DRAWINGS

Aspects of the invention are described with reference to various embodiments, and to the figures, which include.

DETAILED DESCRIPTION

Figure 1:
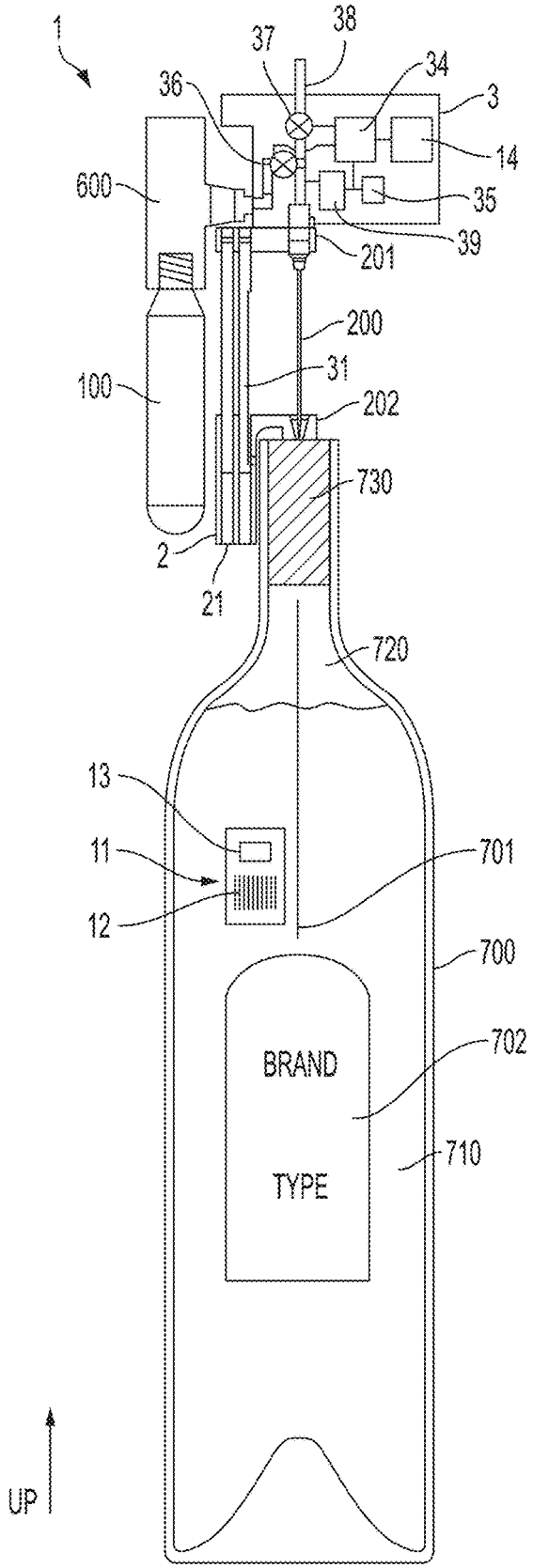
FIG. 1 shows a schematic view of a beverage extraction device in preparation for introducing a conduit through a closure of a beverage bottle.

Aspects of the invention are described below with reference to illustrative embodiments, but it should be understood that aspects of the invention are not to be construed narrowly in view of the specific embodiments described. Thus, aspects of the invention are not limited to the embodiments described herein. It should also be understood that various aspects of the invention may be used alone and/or in any suitable combination with each other, and thus various embodiments should not be interpreted as requiring any particular combination or combinations of features. Instead, one or more features of the embodiments described may be combined with any other suitable features of other embodiments.

FIGS. 1-4 show schematic views of one embodiment of a beverage extraction device (or extractor) 1 and an identification element 11 that incorporate one or more aspects of the invention. Generally, the device 1 is used to insert a needle or other conduit into a beverage container 700, inject gas into the container 700 via the conduit, and dispense beverage forced out of the container 700 by the injected gas or other pressure in the container. This illustrative device 1 includes a body 3 with an attached source of pressurized gas 100 (such as a compressed gas cylinder) that provides gas under pressure (e.g., 2600 psi or less as dispensed from the cylinder) to a regulator 600. In this arrangement, the cylinder 100 is secured to the body 3 and regulator 600 by a threaded connection, although other configurations are possible, such as those described below and/or in U.S. Pat. Nos. 4,867,209; 5,020,395; and 5,163,909 which are hereby incorporated by reference with respect to their teachings regarding mechanisms for engaging a gas cylinder with a cylinder receiver. The regulator 600 is shown schematically and without detail, but can be any of a variety of commercially available or other single or multi-stage pressure regulators capable of regulating gas pressures to a pre-set or variable outlet pressure. The main function of the regulator 600 is to provide gas at a pressure and flow rate suitable for delivery to the container 700 (such as a wine bottle), e.g., so that a pressure established inside the container 700 does not exceed a desired level. In other embodiments, no pressure regulation of the gas released from the cylinder 100 need be done, and instead, unregulated gas pressure may be delivered to the container 700.

In this embodiment, the body 3 also includes at least one valve to control the flow of gas and/or a flow of beverage from the container 700. In this embodiment, a gas control valve 36 is provided to control the flow of gas from the gas source 100 to a conduit in fluid communication with the interior of the container 700, and a beverage control valve 37 to control the flow of beverage from the container 700 to a dispensing outlet 38. (In some embodiments, the dispensing outlet 38 or a portion of the outlet 38 such as a tube may be removable or replaceable, e.g., for cleaning.) However, other arrangements are possible, e.g., a single valve may control the flow of both gas and beverage (e.g., using a three-way valve), a single valve may be used to control gas flow only (e.g., a beverage flow conduit may be always open from the container interior to the dispensing outlet and beverage may flow as gas is introduced into the container), or a single valve may be used to control beverage flow only (e.g., gas flow from the gas source 100 to the container 700 may be always open with the device 1 engaged with a container 700 and beverage flow may be controlled by opening/closing a beverage control valve only). One or both valves 36, 37 may be controlled by a controller 34, i.e., control circuitry. For example, the controller 34 may detect when the device 1 is engaged with a container 700, e.g., by detecting that a needle 200 has been inserted through a cork or a device 1 clamp is engaged with a container neck, and then control the valves accordingly. Where not controlled by a controller, the valves may be manually operable by a user, and/or a user may provide input to the controller 34 to cause the valves to open and/or close. As another option, operation of the valves may be tied together, whether mechanically or via electronic control, e.g., so that when one valve is opened, the other valve is closed, and vice versa, or so that when one valve is open the other valve is open as well (such as when using a two lumen needle).

As discussed more below, the device 1 may include a non-optical reader 14 that can receive information from an identification element 11 on a container 700. The identification element 11 may include a tag 13 which can send information including indicia to the non-optical reader 14 where the indicia uniquely identifies the tag 13 (and thus the identification element 11) from other tags 13. The indicia may be used by the non-optical reader 14 and the controller 34 to identify the container 700 and aspects of the beverage within the container 700. Alternately, or in addition, the controller 34 may determine that the device 1 is engaged with a container 700 when the non-optical reader 14 communicates with a tag 13. For example, the controller 34 may determine the device is engaged with a container 700 when the needle 200 is inserted through a closure 730 and the non-optical reader 14 receives indicia from a tag 13. Although FIG. 1 shows the identification element 11 located below a neck of the container 700 and relatively distant from the device 1, the identification element 11 may be positioned in any suitable location on the container 700. In some embodiments, including those where the device 1 determines it is engaged with a container 700 based on the non-optical reader 14 communicating with the tag 13, the identification element 11 may be positioned on the neck of the container 700 near or at a location where the device 1 engages the container 700. This may enable near field communications between the tag 13 and the non-optical reader 14 such that the device 1 can accurately determine that it is engaged with a container 700 based on reading the tag 13. In some embodiments, at least a portion of the non-optical reader 14 such as an antenna that sends and/or receives radio frequency signals to a tag 13 may be located on a clamp or other portion of the device 1 that is engaged with the container 700. The tag 13 may be located on the container 700 appropriately for communications, e.g., under the clamp or other portion of the device 1 so that the tag 13 is positioned close to the antenna.

Since the indicia may uniquely identify the tag 13, and the container 700 to which the tag 13 is secured, the device 1 may retrieve information specific to the container 700 and beverage in the container. For example, the controller 34 may include a memory that stores information regarding indicia from tags and corresponding information regarding a brand or type of beverage in the container, an amount of beverage remaining in the container, or other characteristics of the beverage. In some embodiments, when a device 1 receives indicia from a tag 13 that it has not encountered before, the device 1 may prompt a user to input various information to the device 1, such as a brand of the beverage, a type of beverage, a beverage volume, etc. This information may be input by a user interface on the device 1, or by a remote device such as a smartphone with a user interface that accepts the information from the user (e.g., by touch screen or voice input) and then sends the information (either directly or indirectly) to the device 1. The controller 34 may store the user-provided information in a memory, and associate the user-provided information with indicia read from the tag 13. In another embodiment, the tag 13 may provide information regarding the container and/or beverage characteristics along with the indicia to the non-optical reader 14. As an example, such type of communication is widely used with RFID tags, e.g., that employ electronic product code (EPC) type identifiers. In this way, the tag 13 could send not only indicia to the non-contact reader 14, but also information regarding the container and its beverage.

In this illustrative embodiment, the identification element 11 includes an optically-readable code 12, which may be a barcode, 2-dimensional barcode, QR code, alphanumeric text, or other code that can be machine read and identified.

While in some embodiments the device 1 could include an imaging device or other component to optically read and identify the optically readable code 12, in this embodiment the device 1 includes only a non-optical reader 14. Like the indicia of the tag 13, the optically readable code 12 may uniquely identify the identification element 11 and the container 700 from others and may be used to associate the identification element 11 with a particular container 700. For example, while a bottler or distributor of the container 700 may apply an identification element 11 to a container 700, a user may apply the identification element 11 to a container 700, e.g., by an adhesive backing on the identification element 11. To associate the identification element 11 with the particular container 700 to which it is secured and suitably store information relating the two, a user may image the optically-readable code 12, e.g., using the camera function of a smartphone or other computer device. The smartphone or other computer device may run an application that analyzes the image of the code 12 and decodes or otherwise determines a unique identifier that the code 12 represents. This unique identifier may be used by the application to create a new container record, which may include information regarding the brand and type of beverage in the container 700, an initial volume of beverage, dispensing parameters for the beverage, etc. In addition or alternately to a computer device automatically determining beverage information, a user may be prompted by the smartphone to enter beverage-related information into a record, e.g., by typing manually or voice input. In another embodiment, the user may employ the smartphone or other computer device to image a label 702 on the container 700 as well, and the image data for the label 702 may be stored with the record regarding the identification element 11. In addition, or alternately, the application (running on the smartphone or on a remote computer) may perform image analysis on the label 102 image, e.g., optical character analysis, to generate alphanumeric text representing a brand, type, volume of beverage or other information included on the label, and this information may be included in the record for the container 700. Alternately, this record information may be retrieved from a remote resource, such as a remote server, that uses the label image data to identify corresponding information in a database. For example, the label image data may be compared to stored image data at the remote server, and when a match is identified, information associated with the stored image data (including beverage brand, type, vintage, volume, etc.) may be retrieved and associated with the record regarding the identification element 11. In one embodiment, a user may employ a smartphone or other computer device to simultaneously image the optically readable code 12 and the label 102 is a same image. This image data may be sent to a remote server, which processes the label 102 information and generates a record for the identification element 11 carrying the code 12 and associated container 700 information. This record may include the tag 13 indicia, the code 12 identifier, a brand/type/vintage/volume/etc. of the beverage, and other information. As discussed more below, records regarding identification elements 11 and associated containers 700 may be used for a variety of different purposes, including controlling dispensing of beverage, tracking beverage volume dispensed and remaining in containers, and other functions.

Figure 2:
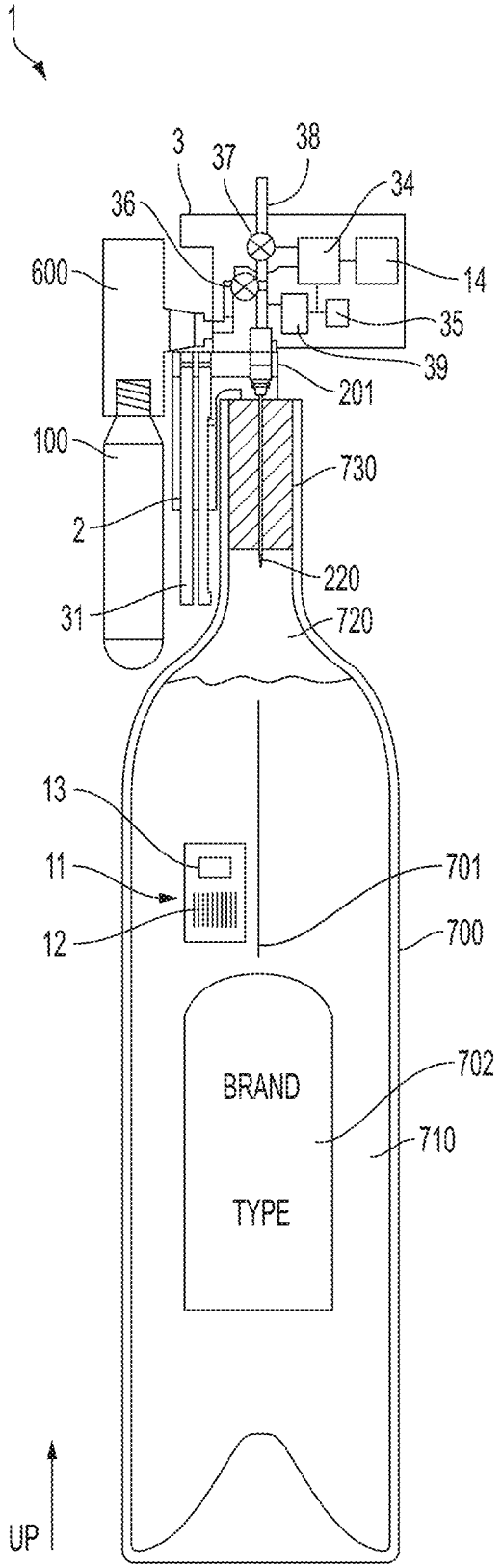
FIG. 2 shows the FIG. 1 embodiment with the conduit passed through the closure.
Figure 3:
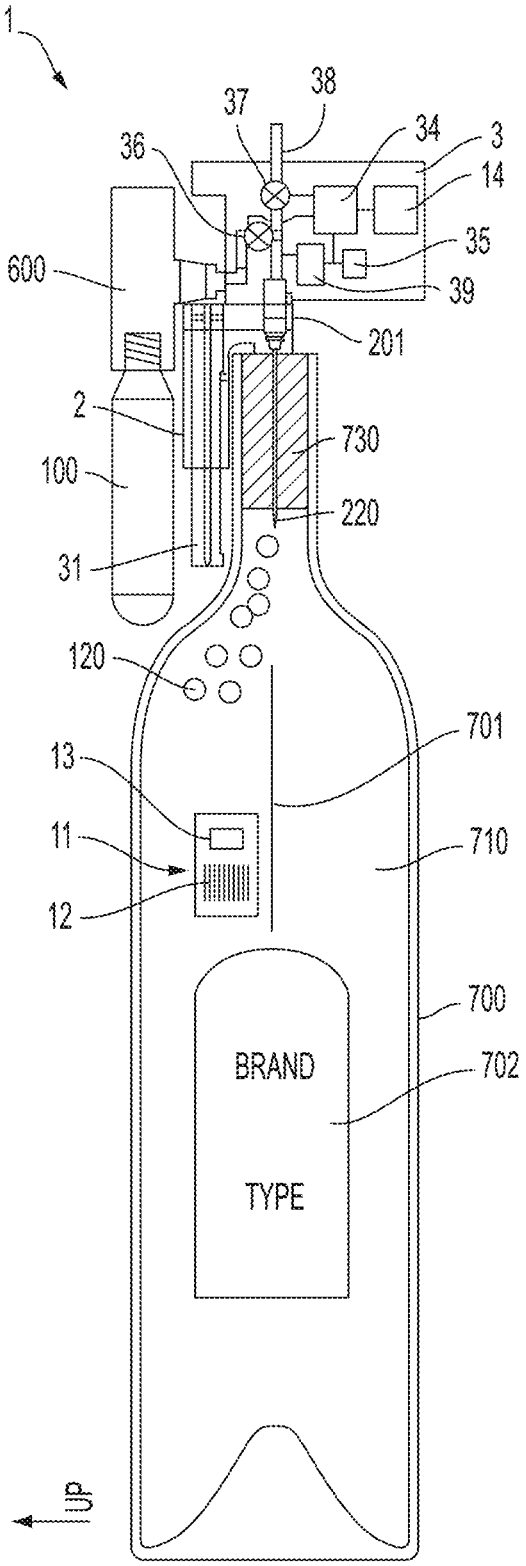
FIG. 3 shows the FIG. 1 embodiment while introducing gas into the bottle.
Figure 4:
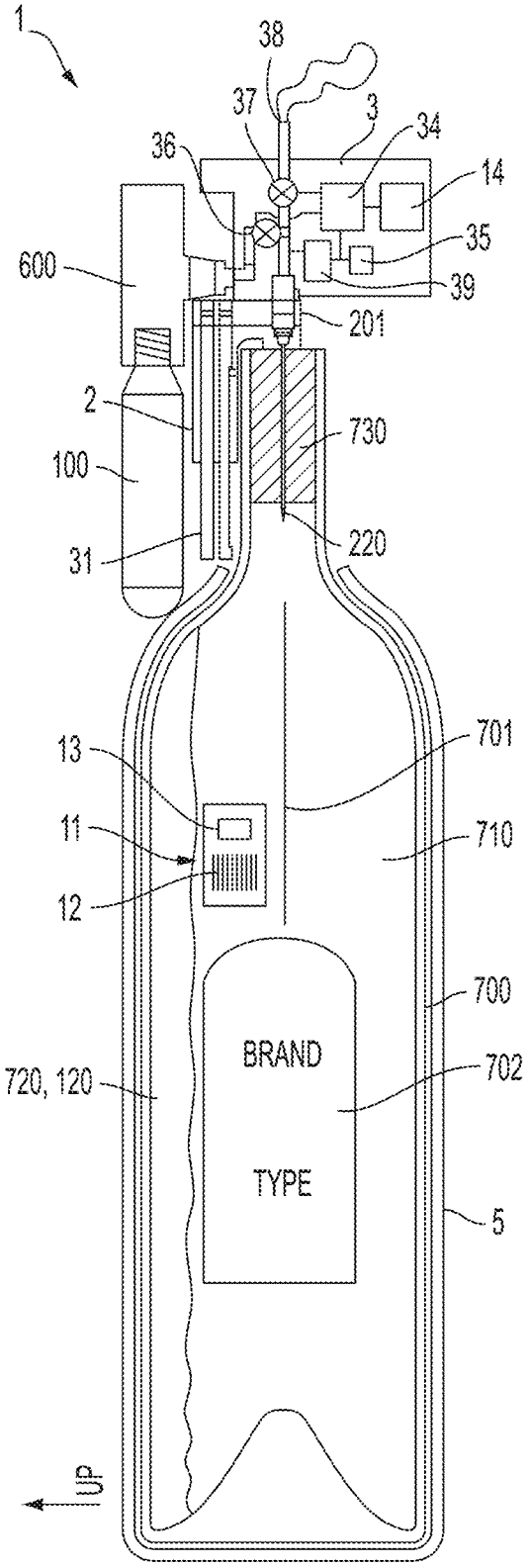
FIG. 4 shows the FIG. 1 embodiment while dispensing beverage from the bottle.

To extract beverage from a container 700 in this embodiment, at least one conduit of the device 1 is put in fluid communication with the interior of the container 700. In this embodiment, a needle 200 attached to the body 3 is inserted through a cork or other closure 730 that seals an opening at a neck of the container 700, as shown in FIG. 2. In this illustrative device 1, the needle 200 includes one or two lumens or conduits with a needle opening 220 along a sidewall of the needle near the needle tip. While the needle 200 may be inserted into and through the cork or other closure 730 in different ways, in this embodiment, the device 1 includes a base 2 (which may be secured to the container 700 by a clamp as discussed below) with a pair of channels 21 that receive and guide movement of respective rails 31 of the body 3. Thus, movement of the body 3 and attached needle 200 relative to the container closure 730 may be guided by the base 2, e.g., the body 3 may slide relative to the base 2 to move the needle 200 into/out of the closure 730. In addition, movement of the needle 200 may be guided by a needle guide 202 that is attached to the base 2 and positioned over the closure 730. To insert the needle 200 through the closure 730, a user may push downwardly on the body 3 while maintaining the base 2 and the container 700 at least somewhat stationary relative to each other. The needle 200 will pass through the closure 730, guided in its motion, at least in part, by the guided motion of the body 3 relative to the base 2 (e.g., by the rails 31 and channels 21). With the needle 200 suitably inserted as shown in FIG. 2, a needle opening 220 at the needle tip may be positioned below the closure 730 and within the enclosed space of the container 700. This allows fluid communication between the interior of the container 700 and one or more conduits of the needle 200.

Other arrangements for guiding movement of the body 3 relative to the base 2 are possible, such as providing one or more rails on the base 2 which engage with a channel or other receiver of the body 3, providing an elongated slot, channel or groove on the body or base which engages with a corresponding feature (e.g., a tab) on the other of the body or base and allows for sliding movement, a linkage that connects the body and base together and allows for movement of the body to insert the needle into the closure, and others.

In embodiments where a needle 200 includes one lumen or conduit, the valves 36, 37 may be controlled to alternately provide pressurized gas into the container 700 and allow beverage to flow from the container 700. For example, gas may first be introduced into the container 700 via the single conduit to establish a pressurized condition in the container 700, and then gas flow may be stopped and pressurized beverage may be permitted to flow out of the single conduit to the dispensing outlet. Where the needle 200 includes two lumens or conduits (or two or more needles are used), one or more conduits may be dedicated to gas flow into the container and one or more other conduits may be dedicated to beverage flow. Thus, the gas control valve 36 may control gas flow into the gas conduit(s), and the beverage control valve 37 may control beverage flow from the beverage conduit(s). Alternately, only one of the valves 36, 37 need be provided to control beverage flow, e.g., the gas control valve 36 may be opened/closed and beverage may flow out of the container and to the dispensing outlet 38 via a dedicated, always open beverage conduit depending on pressure in the container. It should be appreciated that use of a needle or other structure capable of penetrating a cork or other closure is not necessary. Instead, any suitable hose, pipe, tube or other conduit may be used instead of a needle, e.g., a cork may be removed and the conduits fluidly coupled to the container 700, e.g., by a plug or cap through which the conduit(s) extend.

In some embodiments, the beverage extraction device may detect whether the container is in a pour or no-pour orientation, and automatically control portions of the device to dispense beverage while in the pour orientation, but not while in the no-pour orientation. For example, the device 1 may include an orientation sensor 35 constructed and arranged to detect a pour condition when a bottom of the container 700 is positioned above an opening of the container 700 (e.g., where a closure 730 is located). Alternately, the orientation sensor 35 may detect a pour condition when a longitudinal axis 701 of the container 700 is rotated about a horizontal axis by at least 90 degrees, or other movement of the container 700 that represents beverage is to be dispensed from the container 700. To detect such conditions, the orientation sensor 35 may include one or more gyroscopes, accelerometers, mercury or other switches, etc., arranged to detect motion and/or position of the device 1 and container 700 relative to gravity. In another embodiment, the orientation sensor 35 may detect a pour condition when beverage is in contact with a needle 200 or other conduit arranged to receive beverage. For example, the orientation sensor 35 may include a conductivity sensor, float switch or other arrangement to detect the presence of liquid beverage at the distal end of the needle 200 or other conduit that receives beverage.

These conditions, or others, detected by the orientation sensor 35 can be used by the controller 34 to determine that the user has manipulated the container 700 to dispense beverage from the container 700, i.e., the container is in a pour orientation. In response, the controller 34 can control one or more valves to dispense beverage from the container 700. For example, in the illustrative embodiment of FIG. 3, the controller 34 may detect that the container 700 has been rotated 90 degrees or more relative to an upward direction (i.e., a direction opposite to the direction of local gravitational force) and open the gas valve 36 to deliver pressurized gas into the container 700. Thereafter, the controller 34 may close the gas control valve 36 and open the beverage control valve 37 to allow beverage to be dispensed via the dispensing outlet 38. This configuration allows the device 1 to use a single lumen needle 200 to dispense beverage from the container. As will be understood, the controller 34 may cause beverage to be dispensed intermittently, e.g., by alternately opening the gas control valve 36/closing the beverage control valve 37 to deliver pressurized gas into the container 700 and closing the gas control valve 36/opening the beverage control valve 37 to dispense beverage from the container 700. Where the needle 200 or other element has two conduits, the controller 34 may simultaneously open the gas control and beverage control valves 36, 37 to dispense beverage. As noted above, beverage dispensing can be controlled in other ways depending on a number of conduits in fluid communication with the container 700 and/or a valve arrangement. For example, if a two-lumen needle 200 is employed, the device 1 may include only a gas control valve 36 or only a beverage control valve 37, which is opened to dispense beverage and closed to stop dispensing.

The controller 34 may continuously, periodically or otherwise monitor the orientation information from the orientation sensor 35 and control beverage dispensing accordingly. For example, if the orientation sensor 35 detects that the container 700 is no longer in a pour orientation, the controller 34 may stop beverage dispensing, such as by closing the gas and/or beverage control valves 36, 37. If the device 1 is again detected to be in a pour orientation, beverage dispensing may begin again.

In some embodiments, the controller 34 may control an amount or volume of beverage dispensed for each pouring operation, e.g., for each time the device 1 is detected to be in a pour orientation and remains in the pour orientation for an extended period such as 1 second or more. For example, the controller 34 may be configured to dispense a predetermined amount of beverage, such as 4 or 6 ounces/125 ml or 150 ml, for each pouring operation. In other arrangements, the controller 34 can receive user input to select one of two or more volume options, such as pouring a "taste" or relatively small amount, or pouring one or more larger volumes. Thus, the controller 34 may include a push button, voice control, or other user interface to receive selectable dispense volume information. Based on the selected pour volume, the controller 34 may control the operation of the valve(s) to dispense the selected amount. Note that controller 34 control of a dispense volume need not be coupled with an ability to detect whether a container is in a pour/no-pour orientation. Instead, a user may select a desired dispense volume and then press a button or other actuator to initiate dispensing. The controller 34 may stop dispensing when the selected volume has been dispensed, e.g., by closing a suitable valve. The volume of beverage dispensed may be stored by the controller 34, and included with or otherwise used to update a record for the identification element 11/container 700. This may help a user keep track of how much beverage is included with each container 700 in an inventory of containers 700.

The controller 34 can control how much beverage is dispensed in different ways. For example, the controller 34 may include a flow sensor arranged to detect an amount of beverage dispensed and control operation of the valve(s) based on information from the flow sensor. In another arrangement, the controller 34 may determine an amount of beverage dispensed based on a time that the beverage control valve 37 is open for dispensing. Where a pressure in the container 700 and/or other dispense conditions are known (e.g., a flow rate through a needle 200 may be relatively constant even for a relatively wide range of pressures in the container), a time-based control of beverage volume corresponding to an open time for the beverage control valve 37 may be sufficiently accurate. In another embodiment, the controller 34 may determine a flow rate from the container based on a pressure in the container 700, and thus may include a pressure sensor 39 to detect a value indicative of a pressure in the container 700. The pressure sensor 39 may have a sensor element positioned in the container (e.g., at an end of the needle 200), in a conduit between the gas source and the container, or in other suitable locations to provide an indication of pressure in the container 700. The pressure detected by the pressure sensor 39 may be used by the controller 34 to determine a flow rate of beverage from the container 700, and thus determine an amount of beverage dispensed (e.g., a flow rate of beverage out of the dispensing outlet 38 may be related to pressure in the container 700, and by multiplying the flow rate(s) by a dispense time, the dispense volume may be determined).

Information from the pressure sensor 39 may also be used by the controller 34 to control a pressure in the container 700 to be within a desired range. For example, the controller 34 may control pressure in the container 700 to be within a desired range to ensure that beverage is dispensed at a suitably high rate and/or at a known flow rate. In another arrangement, the controller 34 may control the pressure in the container 700 to be somewhat lower, e.g., to preserve gas provided from the gas source 100 and dispense at a slower flow rate. In some cases, a user may be able to set the device 1 to operate in different dispensing modes, such as "fast pour" or "save gas" modes in which the device 1 operates to dispense beverage at a maximum or other relatively high rate using a relatively higher pressure in the container 700 (a fast pour mode) or operates to dispense beverage in a way that uses as little dispensing gas as possible by using a relatively lower pressure in the container 700 (a save gas mode). Alternately, a user could interact with the controller 34 to adjust the dispense rate up or down, or information regarding the type of beverage or other beverage characteristic may be used to determine a dispense rate. Again, the user could provide the dispense speed information by a user interface of the controller 34 or other means, and a selectable dispense rate feature may be used with or without dispense volume control, e.g., where the controller 34 dispenses a specified volume of beverage.

In some embodiments, a dispensing device may be arranged to determine a volume of beverage remaining in a container, and the volume of beverage in the container may be determined based on a change in pressure over a time period that pressurized gas is delivered to the container. For example, the device 1 may include a source of pressurized gas 100 that is used to deliver gas into a container. The device 1 may measure a rate at which pressure increases in the container 700, and based on the pressure rate change determine an amount of beverage in the container. The pressure of gas provided to the container may be regulated, e.g., so that gas is provided at a relatively constant pressure to the container during the pressure rate change measurement. Pressure in the container may be measured, e.g., using a pressure sensor 39, and as will be understood, the rate change of pressure in the container will tend to be lower for containers having less beverage volume and larger gas volume inside the container. The controller 34 may store a look-up table of values that each correspond an amount of beverage remaining with a detected pressure rate change, or may use an algorithm that employs a pressure rate change to determine a remaining volume of beverage. In another embodiment, the controller 34 need not include a pressure sensor 39, and may instead provide gas to the container at a regulated pressure until a pressure in the container equalizes with the regulated pressure. The time over which the container takes to equalize pressure may be used by the controller 34 to determine a remaining beverage volume, e.g., by look up table, algorithm, etc. The controller 34 may prevent beverage dispensing during a time that the container is pressurized during volume remaining measurement, or may dispense beverage during a pressurization period used to determine a volume of beverage in the container. Information regarding a volume of beverage in a container 700 may be included in a record associated with the container 700 and an identification element 11, as discussed above. (Dispensing of beverage during volume remaining measurement need not be problematic to determining the volume remaining since the controller 34 may store information regarding a rate at which flow out of the container occurs, and/or the algorithm, look up table, or other means by which a remaining volume is determined may be arranged to account for dispensing.)

In another embodiment, the device 1 may be arranged to determine a volume of beverage remaining in a container based on a change in pressure in the container while beverage is being dispensed. For example, generally speaking, a container with a larger gas volume will experience a slower drop in pressure for a unit volume of beverage dispensed than a container with a smaller gas volume. This relationship may be used by the device 1 to determine a remaining beverage volume in a container during dispensing. For example, a source of pressurized gas 100 may be used to deliver gas into a container, either before or during beverage dispensing, and the device 1 may measure a rate at which pressure decreases in the container 700 during dispensing. Based on the pressure decrease rate, the controller 34 may determine an amount of beverage in the container. As in other embodiments, the pressure of gas provided to the container may be regulated, or may not be regulated. Pressure in the container may be measured, e.g., using a pressure sensor 39, as discussed above. To determine the remaining volume of beverage, the controller 34 may store a look-up table of values that each correspond an amount of beverage remaining with a detected pressure rate change, or may use an algorithm that employs a pressure rate change to determine a remaining volume of beverage. The determined amount of beverage remaining in the container 700 may be used to control gas delivery for dispensing, e.g., a container having a relatively small amount of remaining beverage may require a larger volume of gas for dispensing a given amount of beverage than a container that is more full. Thus, for example, the controller 34 may adjust gas valve 36 open times depending on a remaining amount of beverage in the container 700.

In another embodiment, the device 1 may include or be associated with a component, such as a scale, that is capable of weighing the container 700 and its beverage both before and after dispensing. The scale may determine the change in weight of the container 700, and thus determine an amount of beverage dispensed and/or remaining in the container. As in other cases above, this information may be used to update a record for the container 700.

In some embodiments, a cross sectional size of one or more lumens in a needle or other conduit or other resistance to flow of the needle/conduit may influence gas and/or beverage flow through the needle or other conduit. In some cases, needles may be coded or otherwise identified so that a controller 34 can receive information regarding a restriction to flow of the needle. For example, needles or other conduits may have an identification number or other text, an RFID tag, a magnet indicator, or other arrangement that includes or represents information regarding flow restriction for the needle. A user may provide the identification number or other indicia to the controller 34 (e.g., by a user interface), or the controller 34 may read the indicia on the needle itself (e.g., in the case of an RFID tag or magnet indicator). The controller 34 may then use the flow restriction information to control gas and/or beverage dispensing.

Where the controller 34 determines an amount of remaining beverage and the device 1 is subsequently (or concurrently) used to dispense beverage, the controller 34 may adjust (reduce) the amount of remaining beverage by an amount of beverage dispensed. For example, the controller 34 may measure an amount of time that a beverage control valve 37 is open and use that information to determine an amount of beverage dispensed. The dispensed beverage may be used to reduce the remaining amount earlier determined to update the remaining amount. Where the controller 34 dispenses during a time that the controller 34 determines an amount of remaining beverage, the controller 34 may take dispensed beverage into account, e.g., an algorithm used to determine an amount of remaining beverage may take beverage dispensed during the measurement operation into account. Note also that the controller 34 may use an amount of dispensed beverage to determine an amount of beverage remaining in a container. For example, when the device 1 is associated with a container 700 that has never been accessed, the device 1 may assume that the container 700 initially has a starting volume of beverage (e.g., 750 ml of wine), and may subtract an amount of beverage dispensed from the starting volume to determine a remaining volume in the container.

The controller 34 may store records regarding an identification element 11 and associated container/beverage information, or may receive such record information for use by the controller 34. As an example, when the device 1 is used with a previously used container, the controller 34 may display a remaining amount of beverage, such as on a visual display, by audibly announcing a remaining amount, etc. In another embodiment, the controller 34 may communicate a remaining amount of beverage or other information to another device, such as a personal computer, server, smartphone or other device, whether by wireless or wired connection. As will be understood, a smartphone or other similar device may operate an application that enables communication with one or more devices 1, manages display of information and/or user input to the device 1, etc. The application may also manage communication between the device 1 and the smartphone, such as by Bluetooth or other wireless communication, so the devices may share information. This may allow a user to view on the smartphone or other device how much beverage is remaining, as well as other information such as a type of beverage in the container, how much gas is left in the gas source 100 or how much beverage can be dispensed with the remaining gas, a type of gas in the gas source 100 (e.g., argon, carbon dioxide, etc.), when a container was first accessed for dispensing, and/or a size of needle mounted on the device (needle size may be relevant for different container closures. For example, a smaller size needle may be desired for certain types of corks or other closures and/or to help ensure that the cork will reseal upon removal of the needle, whereas larger needles may be desired for faster dispense speeds).

Figure 5:
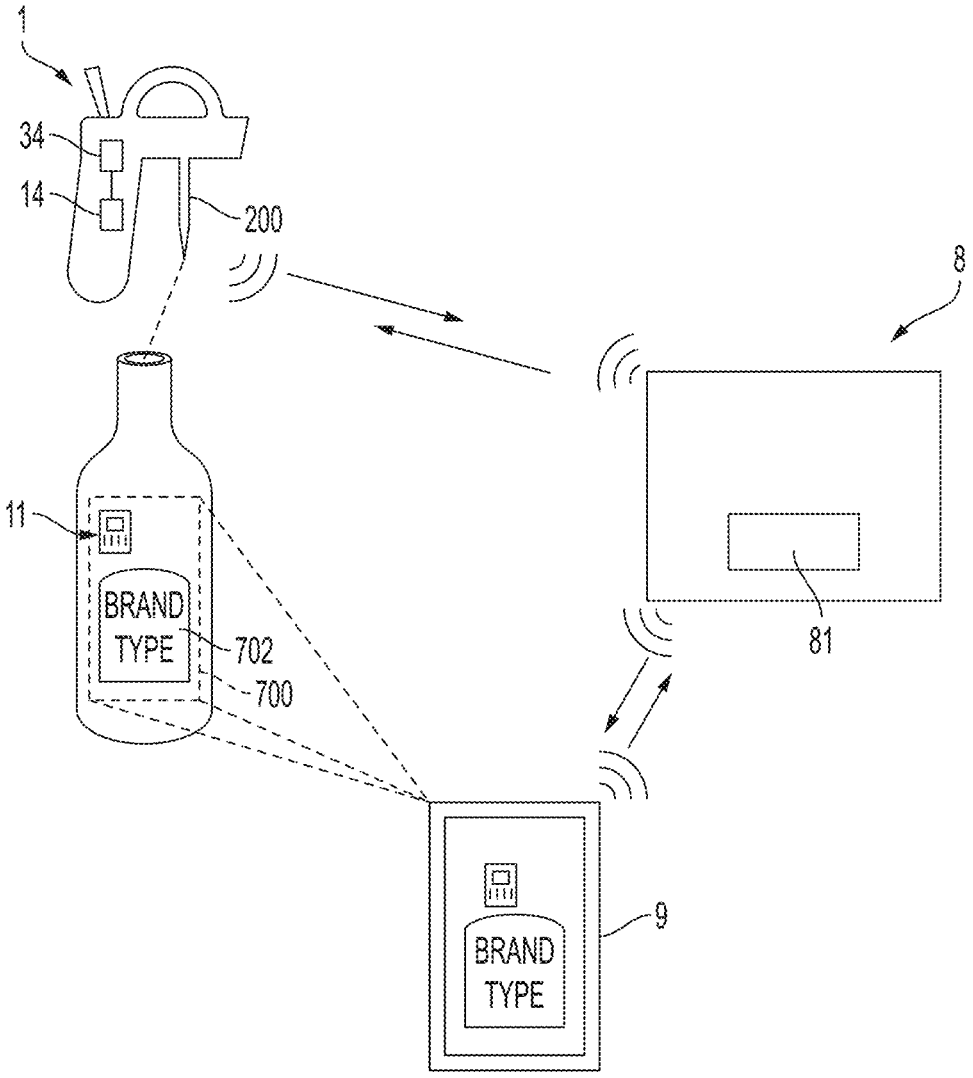
FIG. 5 is a schematic diagram of a beverage tracking and dispensing system in an illustrative embodiment.

FIG. 5 shows a beverage dispensing and information system in an illustrative embodiment. In this example, one or more containers 700 each include an identification element 11 with an optically readable code 12 and a tag 13 that can be read by non-optical means. For example, the tag 13 may be an RFID tag, a magnetic element (e.g., an encoded magnetic strip) whose unique signature can be recognized, an electronic circuit that can be read using one or more electrical contacts or in a contactless way, etc. The identification element 11 may be secured to the container 700 by a user, or by a bottler or distributor of the container 700. If a user would like to keep track of the container 700 or otherwise employ one or more features supported by the identification element 11, the user may run an associated application on a smartphone or other computer device 9. To log the container 700 into the user's system, the user may image the identification element 11 and the label 702 using a camera feature or other imager of the computer device 9. A single image including both the identification element 11 (and the code 12) and a label 702 on the container 700 may be captured and sent by the application to a remote server 8, e.g., via an Internet connection and/or other communications network. The server 8 may identify the identification element 11, e.g., by decoding the optically readable code 12, and retrieve information regarding correspondence of the code 12 identifier and the tag 13 indicia for the identification element 11. (When identification elements 11 are manufactured, information regarding the code 12 identifier and the tag 13 indicia for each identification element 11 may be stored and later accessed by the server 8.) The server 8 may also analyze the label 102 image data, e.g., to determine the brand, type, vintage, volume or other features of the beverage in the container 700. As one example, if the container 700 is a wine bottle, the vineyard, vintage year, wine type, volume of beverage, and other characteristics of the wine may be identified and included in a record associated with the container 700 and the identification element 11. This information may be obtained from optical character recognition processing of the label 102 image, and/or retrieval of stored information by matching the label, or at least some information on the label, with a corresponding set of stored information. The server 8 may create a record 81 for the container 700 and the identification element 11, which may also be associated with the user and/or the computer device 9, and may share the record 81 or portions of the record 81 with the computer device 9 and/or the device 1. As noted above, the server 8 may request, or permit, a user to enter information at the computer device 9 for inclusion in a record for a container 700 and associated identification element 11. This may be useful where, for example, a label 102 cannot be accurately image processed to determine beverage information.

Employing the computer device 9 and the application, a user can request and receive a variety of different information from the server 8. For example, a user could send a search request to the server 8 to identify all wines of a particular type that the user has logged into the system, or all wines that were first accessed for dispensing more than 3 months prior. The server 8 can respond with a report of the containers 700 meeting the criteria, and may include other information as well, such as a last known location of the containers 700, dates when the containers 700 were accessed by a dispenser 1, the amount of beverage remaining, etc. The server 8 could provide other information as well, such as other wines that are similar to the particular type searched by the user, sales offers for the wines that are currently going on, foods that might pair well with the wines searched, etc.

When using a dispenser 1 to dispense beverage from a container 700, the dispenser 1 may receive tag 13 indicia via the non-optical reader 14. This may allow the dispenser 1 to identify the container 700 and control operation or provide user information accordingly. For example, the dispenser 1 may determine that the volume of beverage remaining in the container 700 is relatively low, and increase a pressurized gas flow rate to speed dispensing. The dispenser 1 may determine characteristics of the container 700 by accessing records stored in the dispenser 1 and/or by receiving information from the server 8 and/or the computer device 9. Also, as noted above, the dispenser 1 may send information to the server 8 to update a record corresponding to the container 700, such as an amount of beverage dispensed, a number of times the beverage was dispensed, a date of dispensing, a current location of the container 700, etc. The server 8 may update the record accordingly, and may share information with the computer device 9, e.g., to present a display of the wine currently being dispensed and related information, such as a critic rating of the wine, suggested food pairings, other wines that taste similar, chemical characteristics of the wine, etc. The server 8 and/or the dispenser 1 may also track other information, such as an amount of pressurized gas remaining in a gas cylinder attached to the dispenser 1, and may provide information at the dispenser 1 or the computer device 9 indicating how many pours can be completed with remaining gas supply, requesting whether additional gas capsules should be purchased, etc. As noted above, information may be relayed directly from the device 1 to a user's smartphone or other device 9 for display to the user, whether by visual indication, audible indication, etc.

In some embodiments, the controller 34 may be arranged to determine and track an amount of gas in the gas source, such as a compressed gas cylinder. Such information may be useful, e.g., to alert a user that a gas source is about to run out. For example, in one embodiment the controller may have a pressure sensor 39 arranged to detect a pressure of gas in the gas cylinder 100, and use the detected pressure to determine how much gas remains in the cylinder. This information may be used by the controller 34 to provide information to a user that the cylinder 100 should be replaced, a warning that the cylinder may run out soon, etc. In another embodiment, the controller 34 may determine a pressure in the gas cylinder or other value indicative of an amount of gas left in the cylinder based on an amount of time that a gas control valve 36 or beverage dispense valve 37 is open to cause gas delivery into the container. For example, where a regulator 600 is provided, the controller 34 may store information that represents a total time that the gas source 100 can deliver gas at the regulated pressure. When a gas cylinder or other source 100 is replaced, the controller 34 may detect the replacement and then track a total time that gas is delivered from the gas source 100, e.g., based on how long a gas control valve is open. The total delivery time may be used to indicate an amount of gas left in the source 100, e.g., ¾ full, ½ full, etc., and/or indicate when the source 100 is about to run out. The controller 34 may also refuse to perform a dispensing operation where the gas source 100 does not have sufficient gas to perform the operation. In other arrangements, the controller 34 may determine an amount of gas remaining in a gas source 100 based on how much beverage is dispensed. As discussed above, the controller 34 may determine how much beverage is dispensed from one or more containers, and determine an amount of gas remaining in a gas source 100 based on how much total beverage has been dispensed using the gas source 100. For example, the controller 34 may store information regarding a total number of ounces or other volume measurement a gas source 100 can be used to dispense, and the controller 34 may display an amount of gas remaining that corresponds to the amount of beverage dispensed.

In some embodiments, the controller 34 may detect a gas source 100 and determine characteristics of the gas source 100 for use in operation of the dispensing device 1. For example, the controller 34 may detect an RFID tag, barcode, color tag, or other indicia on a gas source 100 (such as a gas cylinder) an identify a variety of different characteristics of the gas source 100 based on the indicia, such as a type of gas in the source 100, an amount of gas in the source 100, an amount of beverage that may be dispensed using the source 100, an initial pressure of gas in the source 100, etc. The controller 34 may adjust operation of the device 1 based on the type of gas source or other characteristics. For example, if the controller 34 detects that the gas source 100 has a relatively low initial pressure, the controller 34 may select a smaller total beverage volume that can be dispensed using the gas source 100 as compared to a higher pressure gas source. This may allow the controller 34 to more accurately indicate how much gas is remaining in the source 100 over time, i.e., as beverage is dispensed.

In yet another embodiment, the controller 34 may detect when a gas source 100 is nearing an empty state without monitoring how much gas is used from a gas source. In some cases, such as when a single stage regulator 600 is used with a gas source 100, a dispense pressure from the regulator will rise above a normal setting as the gas source 100 is running low. (It is believed that the rise in pressure is due to the relatively low pressure in the gas source 100 being insufficient to cause the regulator valve to close as rapidly as normal.) The controller 34 may detect this rise in pressure using a sensor, such as the pressure sensor 39, and provide an indication that the source 100 is about to run out, stop dispensing operation, or take other suitable action.

As will be appreciated, a beverage extraction device may benefit from a clamp or other arrangement configured to engage the device with a bottle, e.g., by clamping the device to the neck of a bottle. For example, the device can include one or more clamp arms that are movably mounted to the device and are arranged to engage with a bottle to support the device on the bottle during use. The embodiment of FIGS. 6 and 7 has a clamp 4 having a pair of clamp arms 41 that are optionally arranged to support the device 1 in an upright orientation on a flat, horizontal surface 10, such as a table or counter top. (It should be appreciated, however, that a single clamp arm may be provided instead of a pair, as described in more detail below.) In this embodiment, the clamp arms 41 each include a downwardly extending portion 41*c* that contacts the surface 10 along with a lowermost portion of the body 3, which in this example is a lower end of gas cylinder cover 101.

Figure 6:
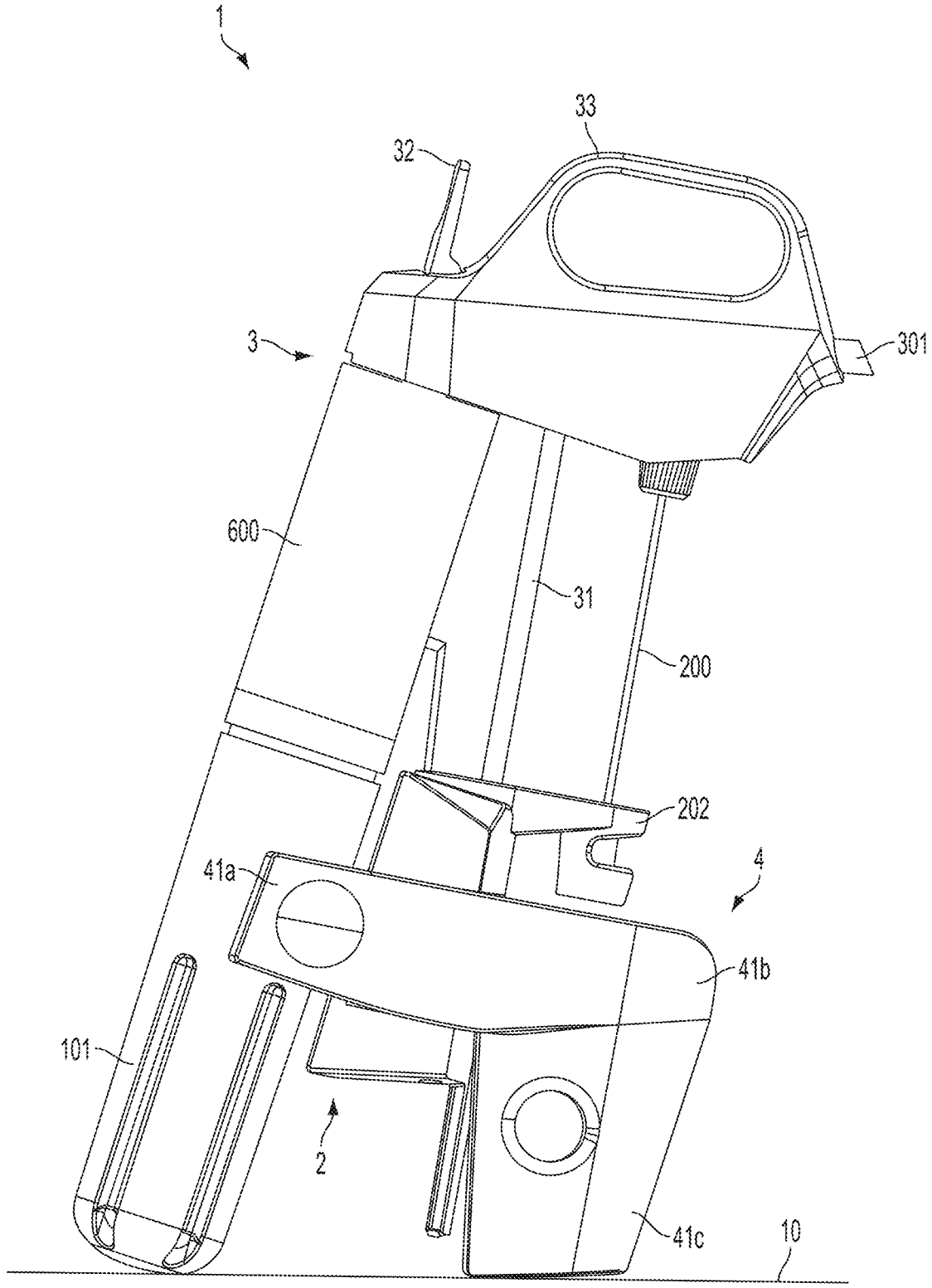
FIG. 6 shows a perspective side view of a beverage extraction device in an illustrative embodiment.
Figure 7:
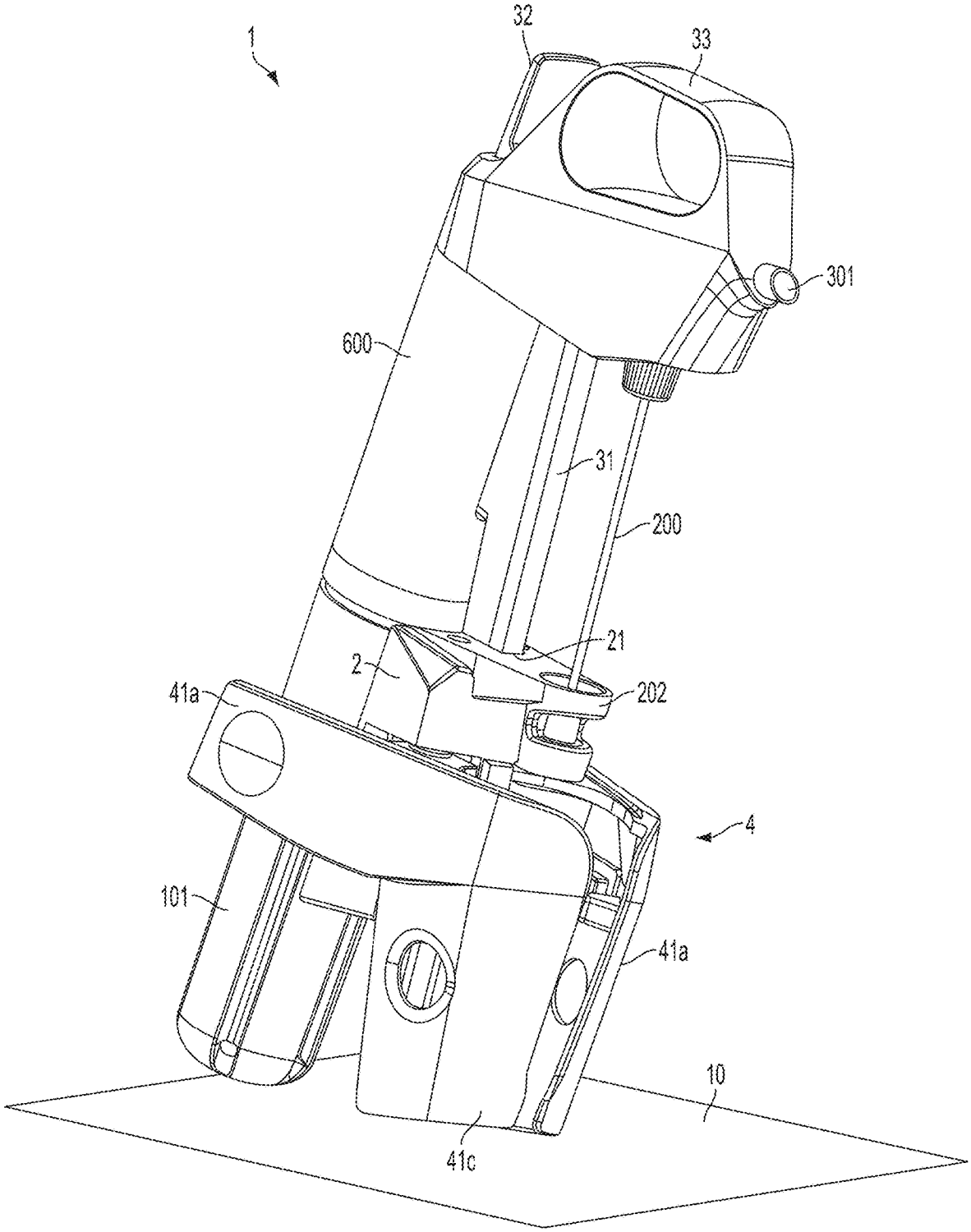
FIG. 7 shows a perspective view of the extraction device of FIG. 5.
Figure 8:
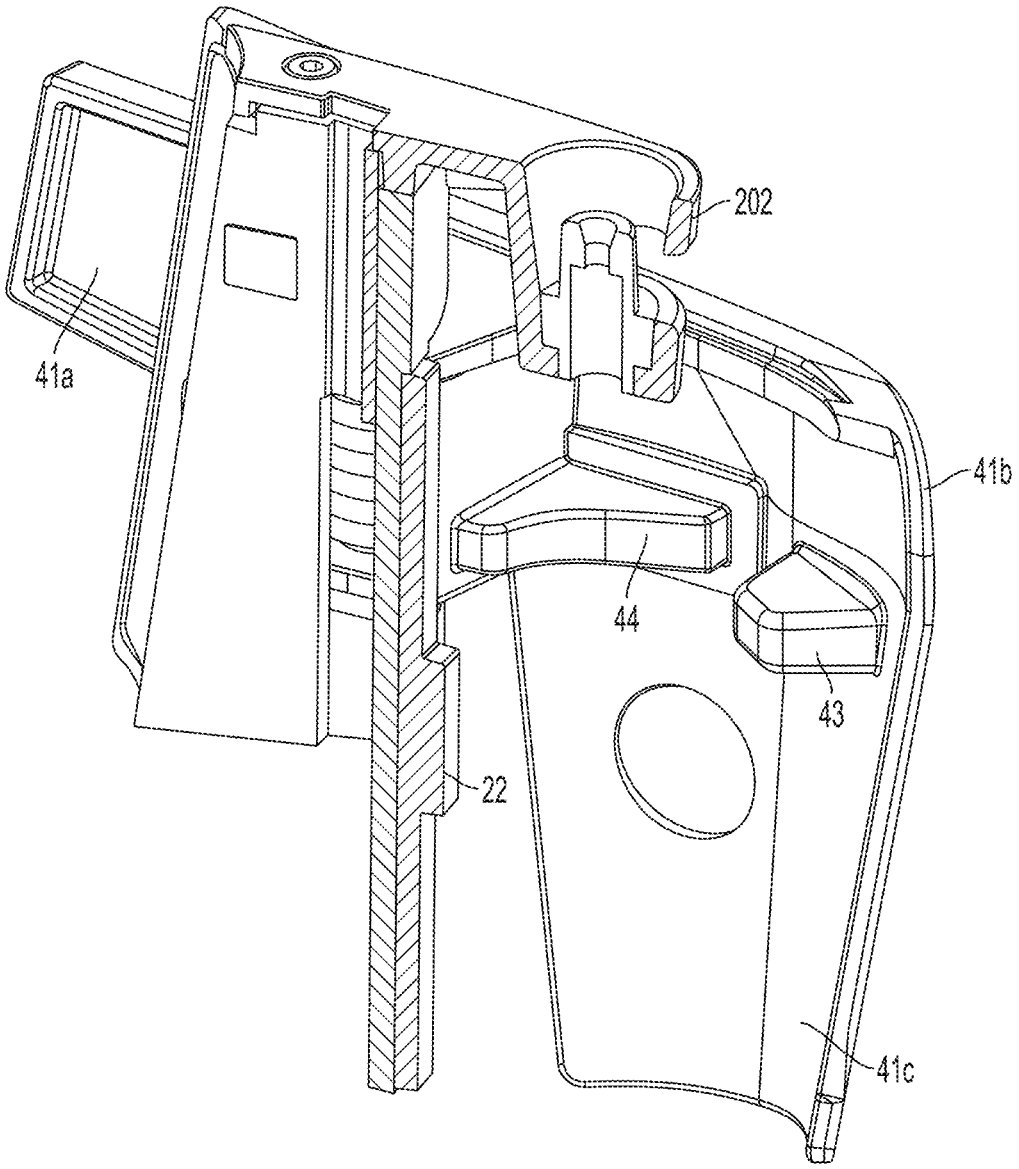
FIG. 8 shows a side view of an inner surface of a clamp arm of the FIG. 5 embodiment.

The clamp arm(s) may also include a feature to help properly engage the clamp arm(s) with a variety of different bottle necks. For example, different bottles may have different neck diameters, different lip diameters or lengths (as used herein, a lip is a feature of many wine bottles near the top of the neck in which the bottle flares, steps or otherwise protrudes outwardly in size). In one embodiment, the clamp arm(s) include a distal tab feature and a proximal ridge feature that cooperate to properly engage with different neck configurations. FIGS. 6-8 show one illustrative embodiment in which each clamp arm 41 includes a distal tab 43 and a proximal ridge 44. The tab 43 may extend radially inwardly somewhat more than the ridge 44, and thus help to center the bottle neck or otherwise appropriately position the neck relative to the clamp arms 41. For example, as the clamp arms 41 are closed on a neck, the tabs 43 may contact the neck before the ridges 44, helping to center or otherwise appropriately position the neck relative to the device 1. In some embodiments, the tabs 43 and/or the ridges 44 may have portions that contact the bottle neck have a relatively hard, low-friction surface to help allow the clamp arms 41 engage the neck while allowing the neck to shift in position relative to the clamp arms 41. The tabs 43 may help urge the neck proximally relative to the base 2, e.g., to move the neck toward a pad 22 located on the base 2 between the clamp arms 41. By urging the neck to move proximally and into contact with the pad 22 or other component, the clamp arms 41 may help position the neck in a consistent way relative to the needle guide 202 and the needle 200. This may help ensure that the needle 200 penetrates the closure 730 in a desired location. For example, with the neck positioned in contact with the pad 22, the needle guide 202 and needle 200 may be arranged to pierce a closure 730 in a location that is offset from a center of the closure 730. This may help avoid having the needle 200 penetrate the closure in the same location if the device 1 is used two or more times to extract beverage from the bottle 700. (As noted above, beverage can be extracted without removal of the closure 730, and since the closure can reseal after removal of the needle, beverage can be extracted multiple times from a bottle 700 without removal of the closure 730, although the closure 730 may be pierced several times to do so.) Alternately, the needle 200 and guide 202 may be configured to penetrate a closure at its center with the neck in contact with the pad 22, and by positioning the neck proximally and in contact with the pad 22, the closure 730 may be penetrated at the center as desired. In another arrangement in which the device is arranged to penetrate the closure 730 at a center position, the clamp arms 41 may each include semi-circular or other suitably arranged surfaces that contact the neck so the center of the closure 730 is always positioned for penetration by the needle 200.

The ridge 44, though optional, may have a length measured in a direction perpendicular to a bottle neck (or in a direction perpendicular to the length of the needle 200) that is greater than the tab 43, e.g., to help the ridge 43 provide a suitably long contact surface for the lip of the bottle. For example, while the tabs 43 may help center the neck between the clamp arms 41 and urge the neck to move proximally, the ridges 43 may contact an underside of the bottle lip with a suitably long surface to help prevent the neck from moving downwardly relative to the clamp arms 41 more than a desired distance. The extended length of the ridges 44 may provide the ridges 44 with greater strength and help the clamp arms operate with a wide array of bottle neck and lip sizes and shapes. In addition, the ridges 44 may have a variable radial length, e.g., increasing proximally as shown in FIG. 7, to help ensure that the ridges 44 will provide suitable engagement with a variety of different necks having different lip dimensions.

The pad 22 in this illustrative embodiment includes a strip of resilient material, such as a rubber, that can help the device grip the bottle neck when engaged by the clamp arms 41. In some embodiments, the pad 22 may include a protrusion or step near a lower portion of the pad 22 (see FIG. 8) so that the pad 22 can engage with a lower surface of a lip on a bottle neck, e.g., similarly to the ridge 44. The pad 22 may extend in a direction along the length of the needle, i.e., along a length of the bottle neck, and may have any suitable length. Generally, however, the pad 22 will have a length that is equal to or shorter than a length of the shortest bottle necks to be engaged by the device 1. Similar is true of the clamp arms 41. That is, the clamp arms 41 may have distal portions 41*b* that extend downwardly, in a direction along the length of the needle 200, to an extent that allows the clamp arms 41 to receive and engage bottles that have a somewhat short neck. In one embodiment, the distal portions 41*b* of the clamp arms 41 may extend downwardly at least to an extent equal to or greater than a lowermost position of the distal end of the needle 200 when the body 3 is positioned at a lowermost position relative to the base 2. In this way, the needle 200 may be prevented from contacting a surface 10 when the device is standing upright on the surface 10. Also, the needle 200 may be movable relative to the clamp arms 41 to be positioned within a space between the clamp arms 41 throughout its full range of movement.

It has been found that needles having a smooth walled exterior, pencil point or Huber point needle of 16 gauge or higher are effective to penetrate through a wine bottle cork or other closure, while sealing effectively with the cork to prevent the ingress or egress of gases or fluids during beverage extraction. Moreover, such needles allow the cork to reseal after withdrawal of the needle, allowing the bottle and any remaining beverage to be stored for months or years without abnormal alteration of the beverage flavor. Further, such needles may be used to penetrate a foil cover or other wrapping commonly found on wine bottles and other bottles. Thus, the needle may penetrate the foil cover or other element as well as the closure, eliminating any need to remove the foil or other wrapping prior to beverage extraction. Other needle profiles and gauges are also usable with the system.

While in the above embodiments the needle guide 202 and needle are positioned to have the needle penetrate the center of the closure 730, the lower opening or through hole of the guide 202 could be arranged to introduce the needle at a location offset from the center of cork 730. This may decrease the chances that a needle penetrates the closure 730 in a same location if the system 1 is used to dispense beverage from the bottle several times and may allow the closure 730 to better reseal upon needle withdrawal.

While in the above embodiments, a user moves the body 3 in a linear fashion relative to the base 2 to insert/remove a needle with respect to a bottle closure, a manual or powered drive mechanism may be used to move a needle relative to a closure. For example, a rail 31 may include a toothed rack, while the base 2 may include a powered pinion gear that engages the rack and serves to move the body 3 relative to the base 2. The pinion may be powered by a user-operated handle, a motor, or other suitable arrangement. In another embodiment, the needle may be moved by a pneumatic or hydraulic piston/cylinder, e.g., which is powered by pressure from the gas cylinder 100 or other source.

A needle used in a beverage extraction device may be a smooth exterior walled, cylindrical needle with a non-coring tip that can be passed through a cork without removing material from the cork. One non-coring tip is a pencil-tip that dilates a passageway through the cork, although deflected-tip and stylet needles have also been found to work properly and could be used in alternative embodiments. The pencil-tip needle preferably has at least one lumen extending along its length from at least one inlet on the end opposite the pencil-tip and at least one outlet proximal to the pencil-tip. As shown above, a needle outlet may be positioned in the side-wall of the needle at the distal end of the needle, although proximal of the extreme needle tip.

With the correct needle gauge, it has been found that a passageway (if any) that remains following removal of the needle from a cork self-seals against egress or ingress of fluids and/or gasses under normal storage conditions. Thus, a needle may be inserted through a closure to extract beverage, and then be removed, allowing the closure to reseal such that beverage and gas passage through the closure is prevented. While multiple needle gauges can work, preferred needle gauges range from 16 to 22 gauge, with an optimal needle gauge in some embodiments being between 17 and 20 gauge. These needles gauges may offer optimal fluid flow with minimal pressures inside the bottle while doing an acceptably low level of damage to the cork even after repeated insertions and extractions.

Multiple needle lengths can be adapted to work properly in various embodiments, but it has been found that a minimum needle length of about 1.5 inches is generally required to pass through standard wine bottle corks. Needles as long as 9 inches could be employed, but the optimal range of length for some embodiments has been found to be between 2 and 2.6 inches. (Needle length is the length of a needle that is operable to penetrate a closure and/or contact a needle guide for guidance in moving through the closure.) The needle may be fluidly connected to the valve directly through any standard fitting (e.g. NPT, RPT, Leur, quick-connect or standard thread) or alternatively may be connected to the valve through an intervening element such as a flexible or rigid tube. When two or more needles are used, the needle lengths may be the same or different and vary from 0.25 inches to 10 inches. Creating distance between the inlet/outlets of the needles can prevent the formation of bubbles.

In some embodiments, a suitable gas pressure is introduced into a bottle to extract beverage from the bottle. For example, with some wine bottles, it has been found that a maximum pressure of between around 40 and 50 psi may be introduced into the bottle without risking leakage at, or ejection of, the cork, although pressures of between around 15 and 30 psi have been found to work well. These pressures are well tolerated by even the weakest of cork-to-bottle seals at the bottle opening without causing cork dislodging or passage of liquid or gas by the cork, and provide for relatively fast beverage extraction. The lower pressure limit in the bottle during wine extraction for some embodiments has been found to be between about 0 and 20 psi. That is, a pressure between about 0 and 20 psi has been found needed in a bottle to provide a suitably fast extraction of beverage from the bottle. In one example using a single 17 to 20 gauge needle, a pressure of 30 psi was used to establish an initial pressure in a wine bottle, and rapid wine extraction was experienced even as the internal pressure dropped to about 15-20 psi.

The source of pressurized gas can be any of a variety of regulated or unregulated pressurized gas bottles filled with any of a variety of non-reactive gasses. In a preferred embodiment, the gas cylinder contains gas at an initial pressure of about 2000-3000 psi. This pressure has been found to allow the use of a single relatively small compressed gas cylinder (e.g., about 3 inches in length and 0.75 inches in diameter) for the complete extraction of the contents of several bottles of wine. Multiple gasses have been tested successfully over extended storage periods, and preferably the gas used is non-reactive with the beverage within the bottle, such as wine, and can serve to protect the beverage oxidation or other damage. Suitable gases include nitrogen, carbon dioxide, argon, helium, neon and others. Mixtures of gas are also possible. For example, a mixture of argon and another lighter gas could blanket wine or other beverage in argon while the lighter gas could occupy volume within the bottle and perhaps reduce the overall cost of the gas.

The embodiments above, a single needle with a single lumen is used to introduce gas into the bottle and extract beverage from the bottle. However, in other embodiments two or more needles may be used, e.g., one needle for gas delivery and one needle for beverage extraction. In such an embodiment, the valve(s) may operate to simultaneously open a flow of gas to the bottle and open a flow of beverage from the bottle. The needles may have the same or different diameters or the same or different length varying from 0.25 to 10 inches. For example, one needle delivering gas could be longer than another that extracts wine from the bottle. Alternately, a two lumen needle may be employed where gas travels in one lumen and beverage travels in the other. Each lumen could have a separate entrance and exit, and the exits could be spaced from each other within the bottle to prevent circulation of gas.

Control of the system may be performed by any suitable control circuitry of the controller 34, which may include a programmed general purpose computer and/or other data processing device along with suitable software or other operating instructions, one or more memories (including non-transient storage media that may store software and/or other operating instructions), a power supply for the control circuitry and/or other system components, temperature and liquid level sensors, pressure sensors, RFID interrogation devices or other machine readable indicia readers (such as those used to read and recognize alphanumeric text, barcodes, security inks, etc.), input/output interfaces (e.g., such as the user interface to display information to a user and/or receive input from a user), communication buses or other links, a display, switches, relays, triacs, motors, mechanical linkages and/or actuators, or other components necessary to perform desired input/output or other functions.

While aspects of the invention have been shown and described with reference to illustrative embodiments, it will be understood by those skilled in the art that various changes in form and details may be made therein without departing from the scope of the invention encompassed by the appended claims.

The invention claimed is:

1. A beverage dispensing system, comprising:

a beverage dispenser including;

at least one conduit to deliver gas into a container holding a beverage and to receive beverage from the container for dispensing;

at least one valve to control gas flow into the container or beverage flow out of the container via the at least one conduit;

a non-optical reader arranged to non-optically read information from a tag including indicia that uniquely identifies the tag from other tags; and control circuitry arranged to send or receive information regarding indicia received from a tag; and a single identification element secured by adhesive to a beverage container, the identification element including a tag arranged to provide information to the non-optical reader including indicia that uniquely identifies the tag from other tags, and an optically-readable code that is machine readable by a device that optically images the code, the optically-readable code including an identifier that uniquely identifies the optically-readable code from other codes, wherein the beverage dispenser is arranged to be disengaged from and reengaged with a beverage container to which the identification element is secured, and wherein the control circuitry is arranged to use the indicia of the identification element to obtain beverage-specific information for the beverage in the beverage container to which the identification element is secured, and to use the beverage-specific information to control a dispense rate at which beverage is dispensed from the beverage container or a pressure in the container for dispensing the beverage.

2. The system of claim 1, wherein the control circuitry is arranged to control the at least one valve based on the beverage-specific information to control a flow of pressurized gas into the container.

3. The system of claim 1, wherein the non-optical reader is an RFID reader, and the tag is an RFID tag that provides the indicia in a radio frequency signal to the RFID reader.

4. The system of claim 1, wherein the optically-readable code is a barcode, a QR code, or alphanumeric text.

5. The system of claim 1, further comprising a computer memory that stores a record including information regarding the indicia and the optically-readable code and at least one characteristic of a beverage in a beverage container to which the identification element is secured.

6. The system of claim 5, wherein the at least one characteristic includes a volume of beverage in the beverage container, a brand of the beverage in the beverage container, a type of the beverage in the beverage container, a vintage of the beverage in the container or at least one date on which beverage was dispensed from the beverage container.

7. The system of claim 1, wherein the identification element is a label that is adherable to the beverage container.

8. The system of claim 1, further comprising a computer system that receives image information including an image of the optically-readable code and a label of a beverage container to which the identification element is secured.

9. The system of claim 8, wherein the control circuitry is arranged to communicate with the computer system to send information to the computer system regarding dispensing of beverage from the beverage container and the indicia received from the tag secured to the beverage container.

10. The system of claim 9, wherein the computer system is arranged to associate the optically-readable code and the indicia of the identification element secured to the beverage container along with a brand of the beverage in the beverage container and information regarding dispensing of beverage from the beverage container, and to provide information for display to a user including a brand of the beverage in the beverage container, a volume of beverage remaining in the beverage container, and a date on which beverage was dispensed from the beverage container.

11. The system of claim 1, wherein the beverage-specific information includes a beverage volume.

12. The system of claim 1, wherein the control circuitry is arranged to use the beverage-specific information to control a pressure in the container for dispensing the beverage.

13. The system of claim 1, wherein the control circuitry is arranged to use the beverage-specific information to control a dispense rate at which beverage is dispensed from the beverage container.

14. A beverage management system comprising:

a beverage dispenser including;

at least one conduit to deliver gas into a container holding a beverage and to receive beverage from the beverage container for dispensing;

at least one valve to control gas flow into the container or beverage flow out of the beverage container via the at least one conduit;

a reader arranged to non-optically read information from a tag including indicia that uniquely identifies the tag from other tags or to optically read an optically-readable code that includes an identifier that uniquely identifies the optically-readable code from other codes; and control circuitry arranged to send or receive information regarding indicia of a tag or an identifier of an optically-readable code;

a plurality of identification elements each arranged to be secured to a beverage container, each identification element including a tag arranged to provide information to a non-optical reader including indicia that uniquely identifies the tag from other tags, and an optically-readable code that is machine readable by a device that optically images the code, the optically-readable code including an identifier that uniquely identifies the optically-readable code from other codes; and a computer device including a memory to store a plurality of records each corresponding to an identification element, each of the plurality of records including information regarding a beverage in a beverage container to which a corresponding identification element is secured, wherein the control circuitry is arranged to use the indicia or identifier of an identification element to obtain beverage-specific information for the beverage in the beverage container to which the identification element is secured, and to use the beverage-specific information to control a dispense rate at which beverage is dispensed from the container or a pressure in the beverage container for dispensing the beverage.

15. The system of claim 14, wherein the record includes information regarding includes a volume of beverage in the beverage container, a brand of the beverage in the beverage container, a type of the beverage in the beverage container, a vintage of the beverage in the container or at least one date on which beverage was dispensed from the beverage container.

16. The system of claim 14, wherein the beverage dispenser is arranged to send information to the computer device regarding a date on which beverage is dispensed from the container or a volume of beverage dispensed from the container, and the computer device is arranged update a record associated with the container to include the information from the beverage dispenser.

17. The system of claim 14, further comprising a beverage container wherein one of the plurality of identification elements is secured to the beverage container by a user.

18. The system of claim 14, further comprising a user computer device arranged to receive information from the computer server regarding one or more records and to display the information on the user computer device to a user, the displayed information including at least one of a volume of beverage in a beverage container, a brand of the beverage in the beverage container, a type of the beverage in the beverage container, a vintage of the beverage in the container or at least one date on which beverage was dispensed from the beverage container.

19. The system of claim 14, wherein the beverage-specific information includes a beverage volume.

20. The system of claim 14, wherein the control circuitry is arranged to use the beverage-specific information to control a pressure in the container for dispensing the beverage.

21. The system of claim 14, wherein the control circuitry is arranged to use the beverage-specific information to control a dispense rate at which beverage is dispensed from the beverage container.

* * * * *